United States Patent [19]

James et al.

[11] Patent Number: 4,697,572

[45] Date of Patent: Oct. 6, 1987

[54] APPARATUS FOR SLURRIFYING SNOW-DEBRIS

[76] Inventors: Steven P. James, 211 Sicily, Ravenna, Nebr. 68869; Roger W. Karr, R.R. 1 (Box 76), Eagle, Nebr. 68347; Gary L. Swanson, 324 W. Pine, Ceresco, Nebr. 68017

[21] Appl. No.: 929,799

[22] Filed: Nov. 13, 1986

[51] Int. Cl.[4] ..... E01C 19/45; F24H 1/00

[52] U.S. Cl. ..... 126/343.5 R; 37/227

[58] Field of Search ..... 126/343.5 R, 343.5 A, 126/19.5; 37/227; 432/13

[56] References Cited

U.S. PATENT DOCUMENTS

| | | | |
|---|---|---|---|
| 2,705,844 | 4/1955 | Pepi | 126/343.5 R X |
| 3,150,660 | 9/1964 | Gontcharuk | 126/343.5 R |
| 3,866,340 | 2/1975 | Krickovich | 126/343.5 R X |
| 4,506,656 | 3/1985 | Baasch | 126/343.5 R |

*Primary Examiner*—Larry Jones
*Attorney, Agent, or Firm*—George R. Nimmer

[57] ABSTRACT

Apparatus and method utilize an open-top hopper having an upper cascade-zone and a lower pool-zone. Crude snow-debris is intermittently dumped into the hopper open-top and there operationally admixed with low-temperature water; this admixture is converted by cascade-zone comminution drums into a rough-slurry that pools at the pool-zone. Within the pool-zone, the rough-slurry is agitated, preferably with a revolvable bladed shaft, into a smoothly flowable-slurry that is dischargeable through an apparatus outlet to a remote disposal site which might be a municipal sewerline. Preferably, the apparatus takes the form of a wheeled vehicle, has a lengthily agitated pool-zone extending beyond the hopper, and is equippable with other desireable optional structural features.

6 Claims, 5 Drawing Figures

APPARATUS FOR SLURRIFYING SNOW-DEBRIS

BACKGROUND OF THE INVENTION

Apparatus and methods for converting excavated solid snowdebris into a liquid form for convenient disposal into a municipal sewerline or other discharge site are alluded to in the numerous prior art mentioned in U.S. Pat. No. 4,506,656 (Baasch-1985). This 1985 Baasch patent recognizes the practical advantages of attempting to rely almost entirely upon the heat content of low-temperature municipal water (e.g. 50° to 55° F.) for converting excavated clumps of snow-debris into a form that permits ultimate disposal into a sewerline or other convenient discharge site. However, because the Baasch technology specifically teaches a substantial entire reliance upon the single long durational operational step of vigorously agitating an admixture of low-temperature water and snow-debris clumps until eventual attainment of a wholly melted condition, the per hour snow-debris disposal capacity thereof is seriously constrained.

OBJECT OF THE INVENTION

It is accordingly the general objective of the present invention to provide apparatus and method for efficiently converting excavated snow-debris clumps into a conveniently disposable flowable form, the snow-debris disposal capacity being unusually efficient eventhough caloric reliance is primarily, or perhaps even substantially entirely, upon that of low-temperature municipally supplied water.

GENERAL STATEMENT OF THE INVENTION

With the aforestated general objective in view, and together with other ancillary and specific objectives which will become more apparent as this description proceeds, the apparatus and method herein for converting excavated solid snow-debris into a conveniently disposable flowable form generally comprises an open-top hopper having an upper cascade-zone adapted to intermittently receive dumped snow-debris clumps and to comminute a cascading admixture of a low-temperature waterflow and the snow-debris clumps into a rough-slurry that pools at a lower pool-zone for the hopper, then agitating the pooled rough-slurry, preferably with a revolvable bladed shaft agitator, to provide a flowable-slurry that is continuously dischargeable through an apparatus outlet means communicating with the pool-zone thereof, and together with other desireable optional features including those relating to apparatus portability, to a spatially augmented agitated pool-zone, to novel powering and transmission means for the apparatus comminution drums and agitator, and to other ancillary features.

BRIEF DESCRIPTION OF THE DRAWING

In the drawing, wherein like characters refer to like parts in the several views, and in which.

DETAILED DESCRIPTION OF THE DRAWING

Figure 2:
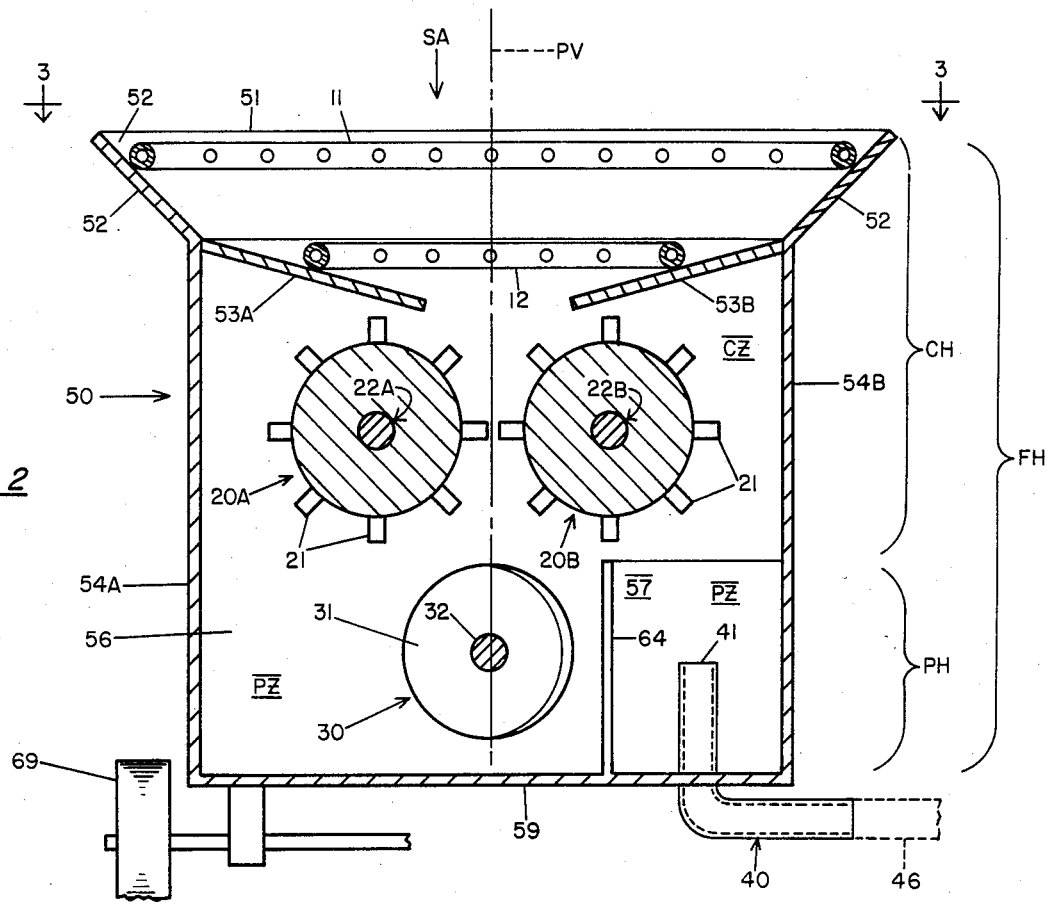
FIG. 2 is a transversely extending sectional elevational view taken along line 2—2 of FIG. 1.
Figure 1:
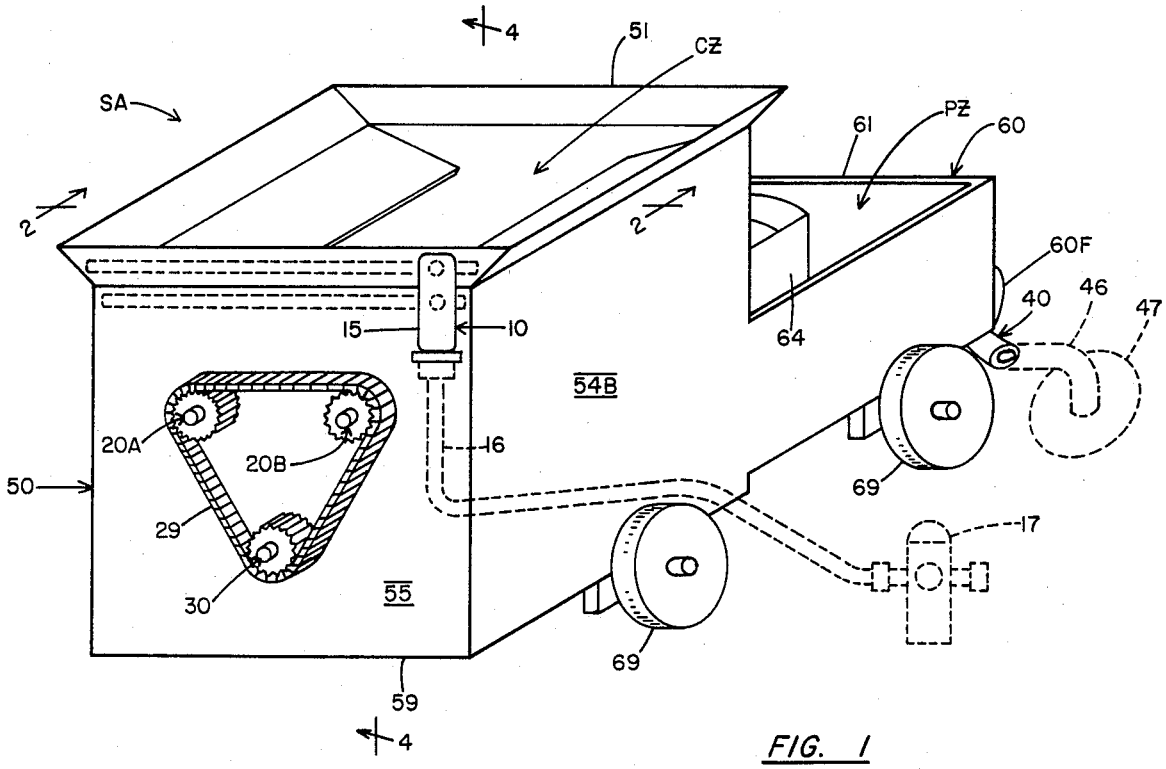
FIG. 1 is a perspective view of a representative embodiment "SA" of the apparatus for for slurrifying snow-debris of the present invention.
Figure 3:
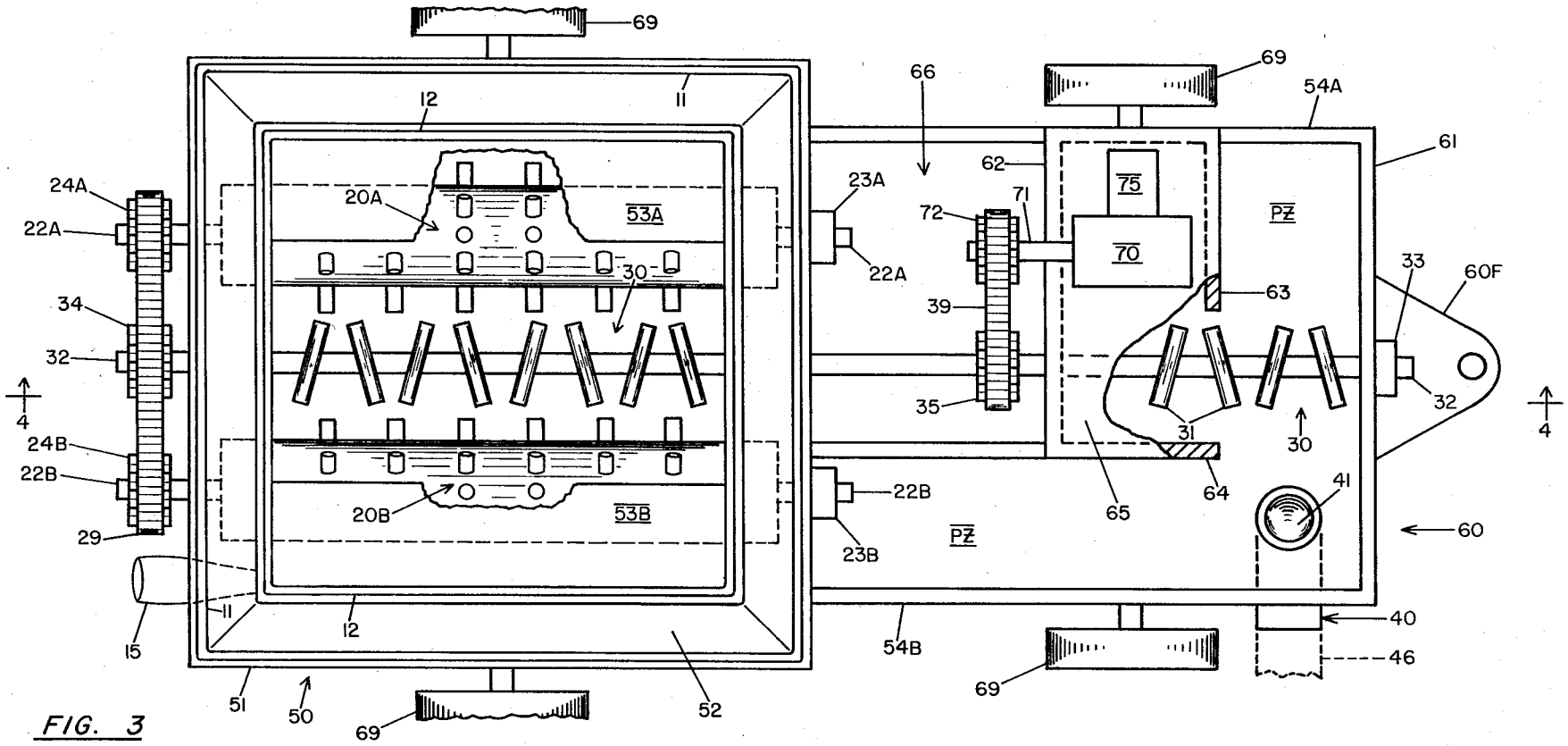
FIG. 3 is a top plan view of representative embodiment "SA" and taken along lines 3—3 of FIGS. 2 and 4.
Figure 5:
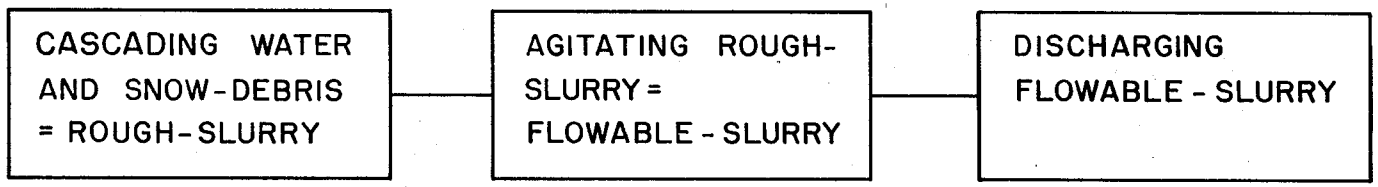
FIG. 5 is a schematic flow diagram referring to salient method steps for converting solid snow-debris into a continuously dischargeable flowable-slurry.
Figure 4:
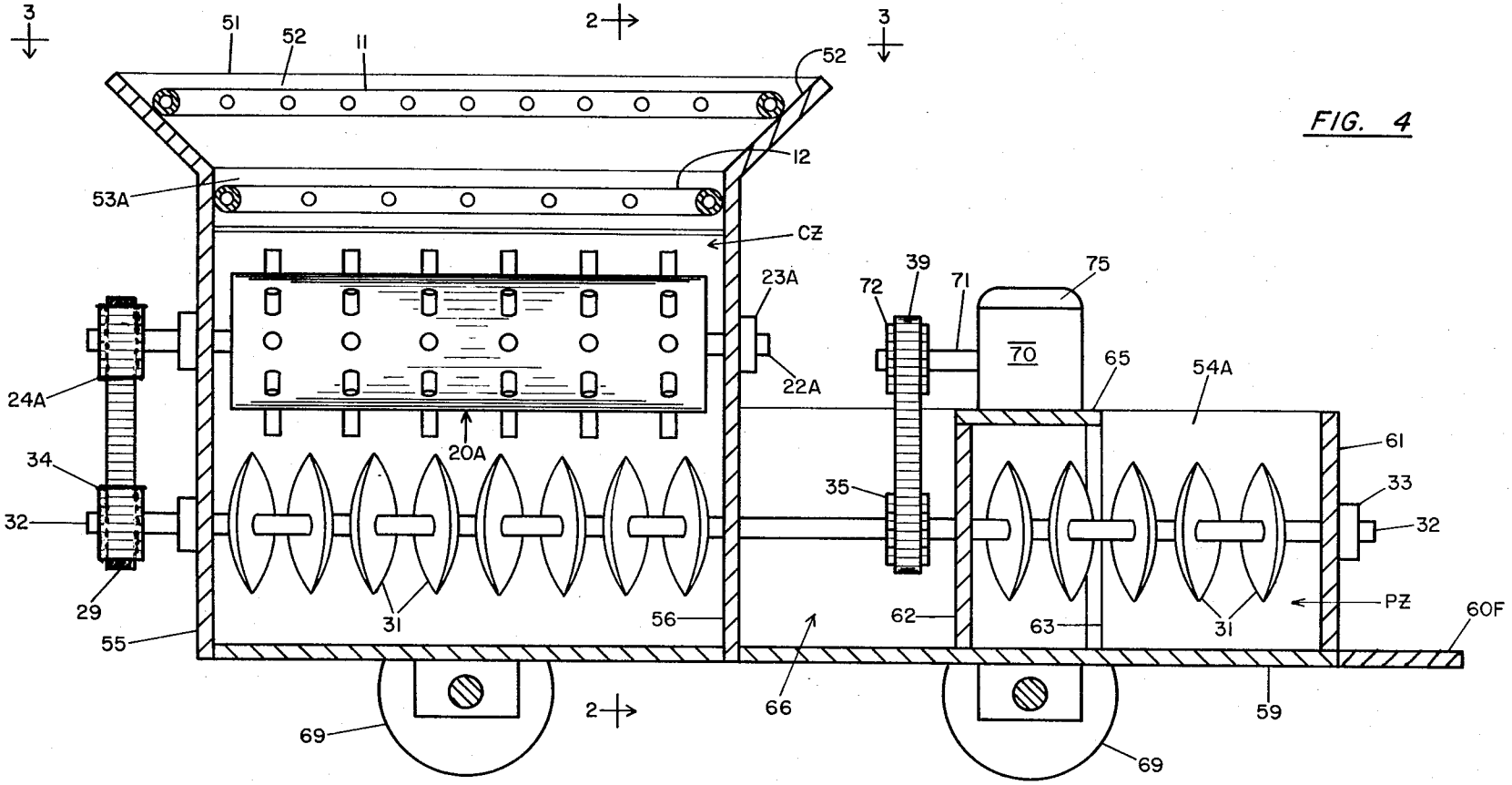
FIG. 4 is a longitudinally extending sectional elevational view taken along lines 4—4 of FIGS. 1 and 3.

The salient method steps described in drawing FIG. 5 are practiceable in an apparatus embodiment "SA" having the five main components alluded to in drawing FIG. 1, namely:

(A) an open-top hopper (50) having therewithin an upper cascade-zone (CZ) and a lower pool-zone (PZ). The hopper might be of powerable and/or vehicular form (60) including a longitudinally augmented pool-zone;

(B) inlet-conduit means (10–12) adapted to continuously introduce low-temperature water into the hopper cascade-zone for admixture with crude snow-debris intermittently dumped into the hopper open-top (51). The low-temperature water might emanate from a hose (16) connected to a municipal water hydrant (17);

(C) located within the hopper cascade-zone (CZ) and flanking the longitudinal vertical-plane (PV), a pair of axially revolvable comminution drums (20A, 20B) and together being adapted to converting the admixture of low-temperature water and snow-debris clumps into a downwardly cascading rough-slurry;

(D) located within the hopper pool-zone (PZ) and extending along vertical-plane (PV), an axially revolvable bladed agitator (30) adapted for refining pooled rough-slurry into a flowable-slurry; and (E) outlet means (40) having a flowable relationship with the hopper pool-zone whereby the flowable-slurry can be continuously discharged to a suitable discharge site (e.g. via hose 46 to a municipal sewerline 47).

As seen in drawing FIGS. 1–4, hopper embodiment 50 might have for its upright wall means: left-wall 54A and right-wall 54B flanking longitudinal vertical-plane PV, transversely extending rearwall 55, and transversely extending front-wall 56; though respectively predominately vertical, these four walls do provide an outwardly flared (52) hopper. The finite overall-height FH between annular open-top 51 and horizontal flooring 59 of hopper 50 is divided into an upper-height (CH) cascade-zone CZ and a lower-height (PH) pool-zone PZ. Herein, left-wall 54A and right-wall 54B are provided with downwardly sloping auxiliary extensions as left-plate 53A and right-plate 53B flanking vertical-plane PV.

The apparatus hopper (e.g. 50) might be of powerable and/or vehicular form such as is generally indicated by reference character 60. In this regard, the hopper flooring (59) and longitudinal walls (54A, 54B) might extend forwardly beyond hopper front-wall 56 and ultimately interconnected by apparatus frontal-wall 61. 60A represents a drawbar at frontal-wall 61, and 69 represents vehicular wheels attachably associated with flooring 59. The apparatus forward extension 60 of hopper 50 might also include a horizontal shelf 65 supported upon transversely extending vertical-plates 62 and 63 which are securely attached to left-wall 54A and which extend part of the distance between walls 54A and 54B. Powering means (e.g. gasoline engine 70 and fuel tank 75) are supportable upon shelf 65. Such apparatus forward extension 60 herein also includes a longitudinally extending upright divider-plate 64 securely attachable to hopper front-wall 56 and to vertical-plates 62 and 63. Accordingly, if hopper front-wall 56 be provided with a transversely offset lower-opening (57), the hopper lower pool-zone PZ will be given an L-shaped forward extension; the latter is longitudinally along the entire extent of right-wall 54B and is transversely along the lengthier (62) of the vertical-plates. Accordingly, such pool-zone forward extension specifically excludes a water-free compartment 66 between vertical-plate 62 and the lower non-open portion of hopper front-wall 56.

The previously alluded to inlet-conduit means 10 might comprise at least one horizontal annular-conduit provided with horizontally extending openings therealong. Herein, two such annular-conduits are employed including a rectangular upper-annulus 11 resting upon the hopper downwardly convergent upper extremity (52) and a rectangular lower-annulus 12 resting upon sloping plates 53A and 53B. Inlet-conduit means 10 also includes a manifold 15 attached to rear-wall 55 and communicating within annular-conduits 11 and 12. A said hose 16 is removably attached to manifold 15. Accordingly, the hopper interior cascade-zone CZ is subjectable to horizontally directed jets of low-temperature water (e.g. from hydrant 17) which is admixed with crude snow-debris intermittently dumped into hopper open-top 51.

Located within the hopper cascade-zone CZ immediately below the inlet-conduit means (11, 12) is a pair of horizontally longitudinally extending comminution drums 20A and 20B. Each said comminution drum is herein provided with a plurality of radially extending cogs or shredders 21 and arrayed at several longitudinally separated peripheral stations of said drum. The respective axial drum-shafts 22A and 22B pass through and are revolvably journalled at hopper walls 55 and 56, as by means of pillow blocks 23A and 23B. Herein, the respective drum-shafts, rearwardly of hopper rear-wall 55, are provided with sprockets 24A and 24B for a removably engaged power transmission chain (e.g. 34). Accordingly, the previously described admixture of inlet-conduit water and snow-debris clumps is downwardly cascadably shreddable at the revolving comminution drums 20A and 20B whereby such admixture is converted into a rough-slurry poolable at the hopper lower pool-zone PZ. Readily selectable pathways for the power transmission chain (34) determine appropriate angular directions for revolvable drums 20A and 20B; these angular directions are empirically determined by the apparatus operator according to the crudeness characteristics of specifically encountered snow-debris excavations.

Located within the hopper pool-zone PZ is agitation means for refining the aforedescribed rough-slurry into a flowable-slurry having laminar flow properties permitting same to be conveyed through a tubular outlet means (e.g. 40, 46) for ultimate disposal to a suitable discharge site (e.g. sewer 47). Preferably, the pool-zone agitation means takes a form 30 including a single horizontal agitator-shaft 32 extending along vertical-plane PV. Agitator-shaft 32, which passes through hopper walls 55 and 56, is appropriately journalled (e.g. 33) for axial revolvability. Carried by and at regular longitudinal increments along agitator-shaft 32 is a plurality of disc-like blades 31 respectively being centrally intersected by and having opposite pitches with respect to agitator-shaft 32. Accordingly, as agitator-shaft 32 is caused to axially revolve (e.g. by powering chain 39), such blades 31 create longitudinally dual-directional turbulence within the pooled rough-slurry and sufficient for agitated refinement into a flowable-slurry that is continuously dischargeable (e.g. at outlet means 40).

Because the second-stage refinement into a flowable-slurry is relatively more crucial that is the rough-slurry first-stage, the axial extent of the agitator means (e.g. 30) preferably exceeds that for the cascade-zone comminution means (20A, 20B). Specifically, though the comminution means is wholly confined within the hopper (50), the pool-zone agitation means is located both within the hopper and in the apparatus forward extension 60. In this vein, propulsion blades 31 exist from substantially hopper rear-wall 55 and to apparatus frontal-wall 61, except being excluded from agitator-shaft 32 at water-free compartment 66. Within such compartment 66, agitator-shaft 32 is provided with sprocket 35 and said transmission chain 39, the latter extending from the sprocketed (72) revolvable power-shaft 71.

As previously mentioned, there is tubular outlet means (40) having an intake-end (41) communicating with the pool-zone and thus having an elevation below cascade-zone CZ. As best seen in drawing FIGS. 1–3, intake-end 41 might be located between front-wall 56 and frontal-wall 61, and thus, within the forward extension of the poolzone. Moreover, the herein angular tubular outlet means 40 has its second (and lower) terminus located immediately externally of rightwall 54B and there permitting removable engagement with a said hose 46 extendable toward an ultimate discharge site (e.g. 47) for the refined flowable-slurry. Accordingly, small proportions of the refined flowable-slurry might be continuously discharged through the tubular outlet-means during continuation of the previous method steps of:

(i) cascadably shredding the admixture of continuously supplied (10) low-temperature water and intermittently dumped (51) snow-debris; and (ii) agitating (30) the downwardly cascaded and pooled rough-slurry into a flowable-slurry.

From the foregoing, apparatus construction and method steps for converting crude snow-debris into a continuously dischargeable flowable-slurry will be readily understood and further explanation is believed to be unnecessary. However, since numerous modification will readily occur to those skilled in the art, it is not desired to limit the invention to the exact constructions shown and described hereabove.

We claim:

1. Apparatus for converting crude snow-debris into a flowable-slurry is flowably dischargeable into a sewer-line or other remote discharge site, said apparatus comprising:

(A) a hopper having upright wall means extending upwardly from substantially horizontal flooring and intersected by a longitudinally extending vertical-plane, said upright wall means including a left-wall and a right-wall flanking said vertical-plane and also including a front-wall and a rear-wall intersecting said vertical-plane, said hopper including a horizontally extending annular open-top located a finite overall-height above said flooring, said overall-height including an upper-height portion extending downwardly from the hopper open-top to provide an apparatus upper cascade-zone confined to said hopper, and the remainder of said overall-height including a lower-height portion extending upwardly from said flooring to provide an apparatus lower pool-zone;

(B) inlet-conduit means located within said hopper cascade-zone and adapted for admixing water with crude snow-debris dumped into said hopper annular open-top;

(C) located within said hopper cascade-zone below said inlet-conduit means, a pair of horizontally longitudinally extending and axially revolvable comminution drums flanking said vertical-plane and respective drums having drum-shafts extending through a hopper wall, said comminution drums together being adapted for converting said admixed water and crude snow-debris into a rough-slurry poolable at said pool-zone;

(D) located within said apparatus lower pool-zone, agitator means for agitating said rough-slurry into a flowable-slurry and comprising a horizontally longitudinally extending an axially revolvable agitator-shaft that extends through a hopper wall and that is provided with propulsion blades, and at least a portion of said agitation means being located within said hopper immediately below said comminution drums;

(E) rearward-transmission means connecting said drumshafts and said agitator-shaft in co-revolvable unison;

(F) apparatus powering means located externally of said hopper and for axially revolving said agitator-shaft; and (G) outlet means for discharging said flowable-slurry, said oultet means including an intake-end communicating with said apparatus lower pool-zone.

2. The apparatus of claim 1 wherein the hopper transversely extending front-wall is provided with a lower-opening therethrough whereby said lower pool-zone extends forwardly beyond said front-wall; wherein said agitation means is located both forwardly and rearwardly of said hopper front-wall; and wherein the outlet means is located forwardly of said hopper front-wall.

3. The apparatus of claim 2 wherein the hopper annular open-top is terminally downwardly convergent, said hopper immediately below said downwardly convergent portion being provided with downwardly sloping left-plate and right-plate; wherein the inlet-conduit means comprises two annular-conduits respectively provided with horizontally extending openings therealong and including an upper-annulus located above said downwardly sloping plates and a lower-annulus located substantially co-elevational with said downwardly sloping plates; wherein both comminution drums are located wholly rearwardly of said rear-wall, each said drum having radially outwardly extending cogs for reducing said admixed water and snow-debris clumps into a downwardly cascading rough-slurry; wherein the agitation means propulsion blades are alternatively pitched discs respectively centrally intersected by said attached agitator-shaft; and wherein the rearward-transmission means includes a chain removably connected to sprockets carried by said two drum-shafts and said agitator-shaft.

4. The apparatus of claim 1 wherein the inlet-conduit means comprises at least one annular-conduit provided with horizontally extending openings therealong.

5. The apparatus of claim 4 wherein the hopper annular open-top is terminally downwardly convergent, said hopper immediately below said downwardly convergent upper terminus being provided with downwardly sloping plates as a left-plate and a right-plate flanking said vertical-plane; and wherein there are at least two said annular-conduits including an upper-annulus located above said downwardly sloping plates and a lower-annulus located at said downwardly sloping plates.

6. Apparatus for converting crude snow-debris into a flowable-slurry that is flowably dischargeable into a sewerline or other remote discharge site, said apparatus comprising:

(A) a hopper having upright wall means extending upwardly from substantially horizontal flooring and intersected by a longitudinally extending vertical-plane, said hopper including a horizontally extending annular open-top located a finite overall-height above said flooring, said overall-height including an upperheight portion extending downwardly from the hopper open-top to provide an apparatus upper cascade-zone confined to said hopper, and the remainder of said overall-height including a lower-height portion extending upwardly from said flooring to provide an apparatus lower pool-zone;

(B) inlet-conduit means located within said hopper cascade-zone and adapted for admixing water with crude snow-debris duped into said hopper annular open-top;

(C) located within said hopper cascade-zone below said inlet-conduit means, a pair of horizontally longitudinally extending and axially revolvable comminution drums flanking said vertical-plane, each of said drums having drum-shafts extending through a hopper wall and having a plurality of longitudinally separated and radially extending arrays of cog-like shredders, said comminution drums together being adapted for converting said admixed water and snow-debris into a rough-slurry poolable at said pool-zone;

(D) located within said apparatus lower pool-zone, agitator means for agitating said rough-slurry into a flowable-slurry and comprising a horizontally longitudinally extending and axially revolvable agitator-shaft journalled by said hopper and that is provided with propulsion blades, and at least a portion of said agitation means being located within said hopper immediately below said comminution drums;

(E) rearward-transmission means connecting said drumshafts and said agitator-shaft in co-revolvable unison;

(F) apparatus powering means located externally of said hopper and for axially revolving said agitator-shaft; and (G) outlet means for discharging said flowable-slurry, said outlet means including an intake-end communicating with said apparatus lower pool-zone.

* * * * *